United States Patent [19]

Nicholl

[11] 3,936,022

[45] Feb. 3, 1976

[54] LANTERN AND SUPPORT STRUCTURE THEREFOR

[76] Inventor: Thomas H. Nicholl, 1204 W. 27th, Kansas City, Mo. 64108

[22] Filed: Dec. 2, 1974

[21] Appl. No.: 528,874

[52] U.S. Cl. ..... 248/137; 248/140; 240/52.5

[51] Int. Cl.[2] ..... A47F 5/12

[58] Field of Search ..... 248/104, 105, 106, 107, 248/126, 139, 140, 141, 142, 145.3, 145.6, 454, 456, 457, 474, 477, 479, 137, 143, 144, 24 R, 24 A; 211/69.6, 69.7, 69.9; 240/10.63, 52.3, 52.5, 57.1, 61.6, 61.8

[56] References Cited

UNITED STATES PATENTS

| | | | |
|---|---|---|---|
| 1,113,034 | 10/1914 | Miller | 248/456 |
| 1,237,191 | 8/1917 | Friend | 240/52.5 |
| 1,782,108 | 11/1930 | Wahl | 211/69.7 |
| 1,807,491 | 5/1931 | Montieth | 240/52.3 |
| 2,052,120 | 8/1936 | Vaughan | 248/126 |
| 2,433,091 | 12/1947 | Chenette | 248/107 |
| 3,329,810 | 7/1967 | Meagher | 240/52.5 |
| 3,628,005 | 12/1971 | Rhoades | 248/126 |
| D175,258 | 8/1955 | Jackson | D48/24 |

FOREIGN PATENTS OR APPLICATIONS

| | | | |
|---|---|---|---|
| 12,656 | 9/1915 | United Kingdom | 248/456 |

*Primary Examiner*—James T. McCall
*Assistant Examiner*—Robert A. Hafer
*Attorney, Agent, or Firm*—Fishburn, Gold & Litman

[57] ABSTRACT

An electric lantern and support structure therefor wherein the lantern has a housing having laterally spaced side walls and an end wall at one end and a reflector, bulb, and lens at the other end forming a closed substantially waterproof compartment therein for containing batteries and electrical circuiting. The support structure has a base portion and laterally spaced side arms extending from the base portion. The side arms each have an end portion or gudgeon pivotally supported in bearing and pivoting sockets of respective side walls. The arms are biased toward each other and have portions spaced from the gudgeon resiliently retained in frictional engagement with outstanding housing portions, such as longitudinally extending ribs, whereby the support structure and housing may be moved through a wide angle for any selected position and frictionally retained in the selected position and frictionally retained in the selected position including a latched position of said support structure for carrying of the lantern by its handle.

7 Claims, 5 Drawing Figures

LANTERN AND SUPPORT STRUCTURE THEREFOR

The present invention relates to stands for articles and more particularly to a lantern and support structure therefor wherein the lantern or article may be moved to a selected position relative to the support structure and frictionally retained in any selected position.

The principal objects of the present invention are: to provide an article and a support structure therefor which holds the article stable in any selected position; to provide such an article and support structure therefor wherein the article has a housing having outstanding portions to be frictionally engaged by arms of the support structure to frictionally hold the housing in a selected position relative thereto; to provide such a combination wherein the outstanding portions are ribs and each have an end portion tapering toward one end of the housing to effect positive movement of the arms into engagement with the housing to hold the base of the support at the end of the housing for carrying the lantern or for positioning same in an upstanding position; to provide such a structure wherein the arms are biased toward each other and the normal spacing between the arms is less than the width of the housing at the outstanding portion thereof; to provide such a combination wherein the support structure is removably mounted on the housing; to provide such a combination wherein the support structure has spaced arms having trunnion or gudgeon ends received in respective recesses or sockets on the side walls of the housing and wherein the arms may have relative lateral movement and the ends are spaced from inner ends of the recesses or sockets when the arms engage a peripheral edge of respective ribs on the housing; and to provide such a lantern and support structure therefor which is attractive in appearance, positive in operation, durable in construction, and particularly well adapted for the proposed use.

Other objects and advantages of this invention will become apparent from the following description taken in connection with the accompanying drawings wherein are set forth, by way of illustration and example, certain embodiments of this invention.

The drawings constitute a part of the specification and include an exemplary embodiment of the present invention and illustrate various objects and features of the lantern and support structure therefor.

Figure 3:
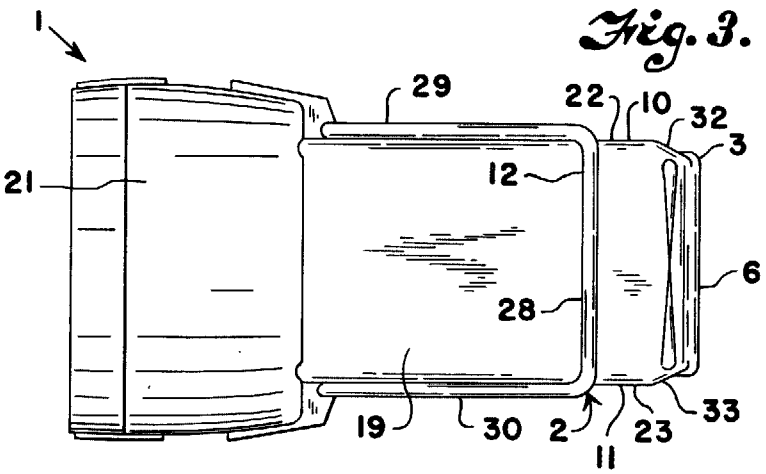
FIG. 3 is a bottom plan view of the lantern housing.
Figure 2:
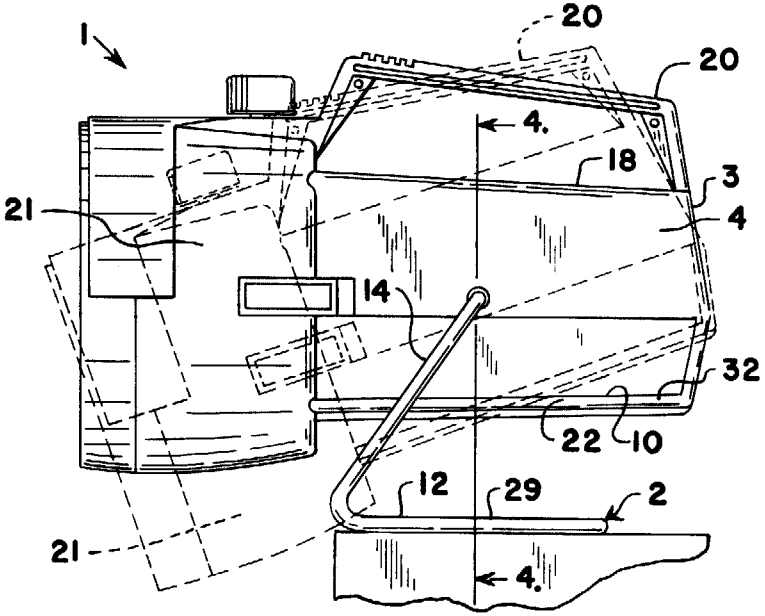
FIG. 2 is a side elevational view of the lantern and support structure therefor with alternate positions of the lantern housing shown in broken lines.

Referring more in detail to the drawings:

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting but merely as a basis for the claims and as a representative basis for teaching one skilled in the art to variously employ the present invention in virtually any appropriately detailed structure.

In the disclosed embodiment of the present invention, the reference numeral 1 generally designates an article, such as a lantern, having a support structure 2 therefor which permits relative movement between the article 1 and support structure 2 and retains the article 1 in a selected position. The lantern 1 has a housing 3 illustrated as having laterally spaced side walls 4 and 5 and an end wall 6 at one end and a lens 7, reflector 8, and bulb 9 at the other end forming a closed substantially waterproof compartment therein for containing a battery and electrical circuitry (not shown). The housing side walls 4 and 5 have outstanding portions 10 and 11 respectively shown as ribs extending longitudinally from adjacent the housing end wall 6. The support structure 2 has a base portion 12 and laterally spaced side arms 14 and 15 extending from the base portion 12. The arms 14 and 15 have end portions or gudgeons or trunnions 16 and 17 pivotally supported on the side walls 4 and 5 respectively, as later described. The arms 14 and 15 are resiliently retained in frictional engagement with the outstanding portions or ribs 10 and 11 respectively whereby the housing 3 may be moved to any selected position relative to the arms 14 and 15 and frictionally retained in the selected position until moved to a new position.

The housing 3 and support structure 2 may be any desired form wherein the support structure has inwardly biased arms with trunnions pivoted on the housing with outstanding portions thereof engaged by the arms to hold the support structure and housing in any selected position between certain pivoting limits. The illustrated housing 3 includes the side walls 4 and 5 positioned in opposed and substantially parallel relation. A top wall 18 and a bottom wall 19 each extend between the side walls 4 and 5 to define an elongated tubular housing closed at one end by the end wall 6. The illustrated article or lantern 1 is portable and preferably includes a handle 20 mounted on the top wall 18 of the housing 3 to permit easy carrying of the lantern 1. The handle 20 has an end portion engageable by the support structure 2, for a purpose later described.

The other end of the housing 3 has a side wall 21 defining a generally cylindrical bezel portion adapted to receive the reflector 8, bulb 9, and lens 7.

The ribs 10 and 11 extend outwardly from the side walls 4 and 5 respectively and in the illustrated structure, the ribs 10 and 11 are coplanar with the bottom wall 19 of the housing 3 and have crests or edges 22 and 23 respectively. The crests or edges 22 and 23 are spaced outwardly from the side walls 4 and 5 respectively. The end portions or trunnions 16 and 17 of the arms 14 and 15 of the support structure 2 are pivotally supported on the side walls 4 and 5 of the housing 3. In the illustrated structure, the side walls 4 and 5 have bearing recesses or sockets 24 and 25 therein to rotatably receive said end portions 16 and 17. The recesses 24 and 25 are spaced from the ribs 10 and 11 and from the end wall 6. The recesses 24 and 25 extend transversely of the housing 3 and are axially aligned and each has a side surface 26 and an end surface 27 to thereby close the respective recess.

The support structure 2, as illustrated, is formed of heavy metal wire or rod and the base portion 12 has an end member 28 and laterally spaced side members 29 and 30 extending from opposite ends of the end member 29. The side members 29 and 30 have a greater spacing therebetween than the distance between the side walls 4 and 5 and crests or edges 22 and 23 to permit the end portion of the housing to move therebetween.

The side arms 14 and 15 extend from the side members 29 and 30 respectively and converge therefrom, but are substantially coplanar therewith when said arms engage the edges 22 and 23. This spreading of the arms provides the bias thereof and the frictional engagement with the ribs. The end portions or trunnions 16 and 17 of the side arms 14 and 15 are substantially normal to the major portion of the side arms 14 and 15 whereby the end portions 16 and 17 are received in the recesses 24 and 25 respectively while the side arms 14 and 15 are spaced from and substantially parallel with the side walls 4 and 5 respectively of the housing 3. When the arms 14 and 15 are in engagement with the edges 22 and 23 of the ribs 10 and 11 respectively, the inner ends of the end portions 16 and 17 are each spaced, as at 31, from the respective end surface 27 of the recesses 24 and 25. The length of the gudgeons or end portions 16 and 17 and depth of the recesses are such that suitable bearing support is maintained in all positions of the support structure and housing and always some space at 31 to maintain the biased engagement of the arms with the outstanding portions of the housing.

The housing 3 may be formed of any suitable material adapted to have therein components of the lantern 1. The support structure 2 for the lantern 1 is formed of substantially rigid material having sufficient resiliency to maintain the arms 14 and 15 in engagement with the crests or edges 22 and 23 of the ribs 10 and 11 respectively to thereby frictionally maintain the housing 3 in any selected position. The support structure 2 may be moved to a storage position wherein the arms 14 and 15 are moved along the edges 22 and 23 respectively and beyond end portions 32 and 33 of the ribs 10 and 11 respectively. The end portions 32 and 33 are inclined or taper from the edges 22 and 23 respectively toward the side walls 4 and 5 and form shoulders engaged by the side arms. The side arms 14 and 15 thereby are biased into engagement with adjacent portions of the side walls 4 and 5, or opposite edges of the end wall 6, to thereby clampingly engage the housing 3 and position the support structure in a storage position whereby the lantern 1 may be carried by the handle 20. The end member 28 of the base portion 12 is in engagement with the end portion of handle 20 when the support structure 2 is in the storage position.

Figure 1:
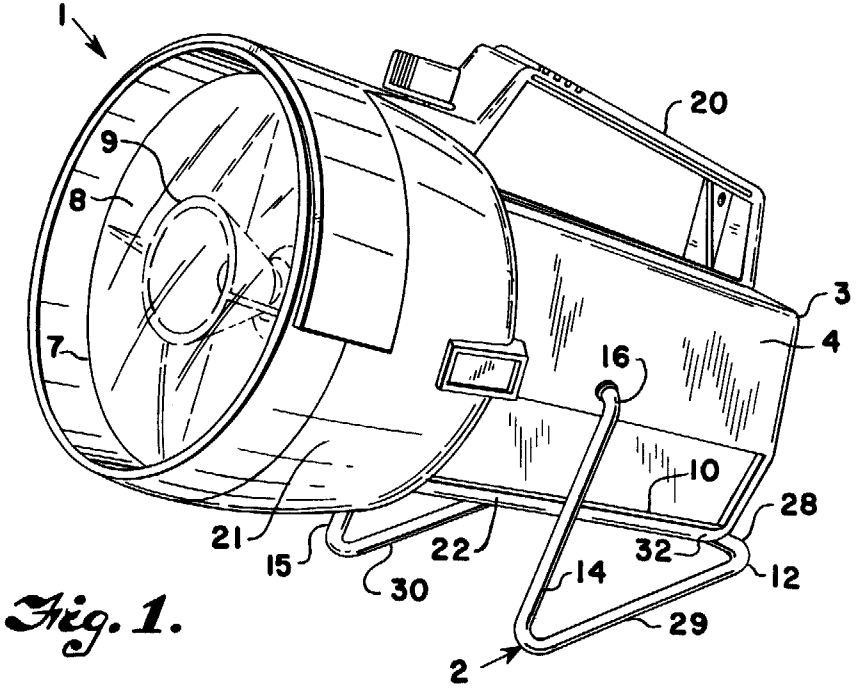
FIG. 1 is a perspective view of a lantern and support structure therefor embodying features of the present invention.
Figure 5:
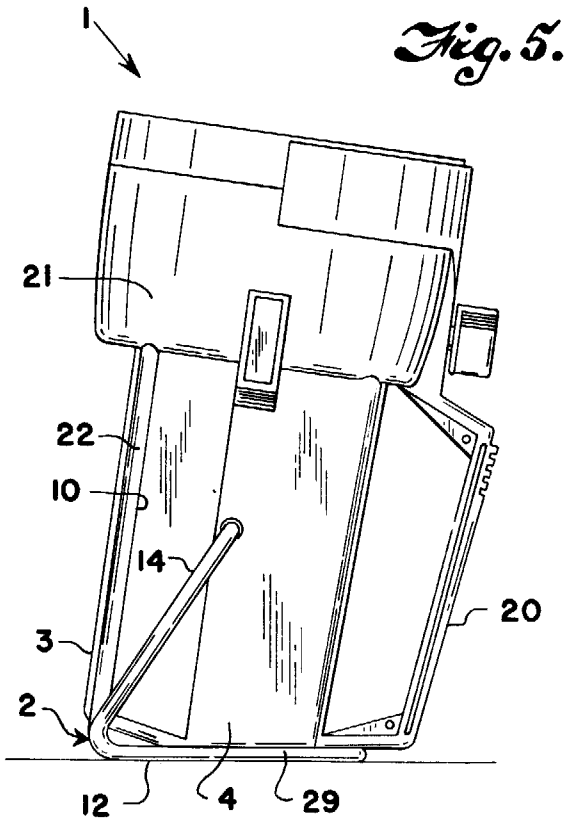
FIG. 5 is a side elevational view of the lantern with the support structure in storage or standing position.
Figure 4:
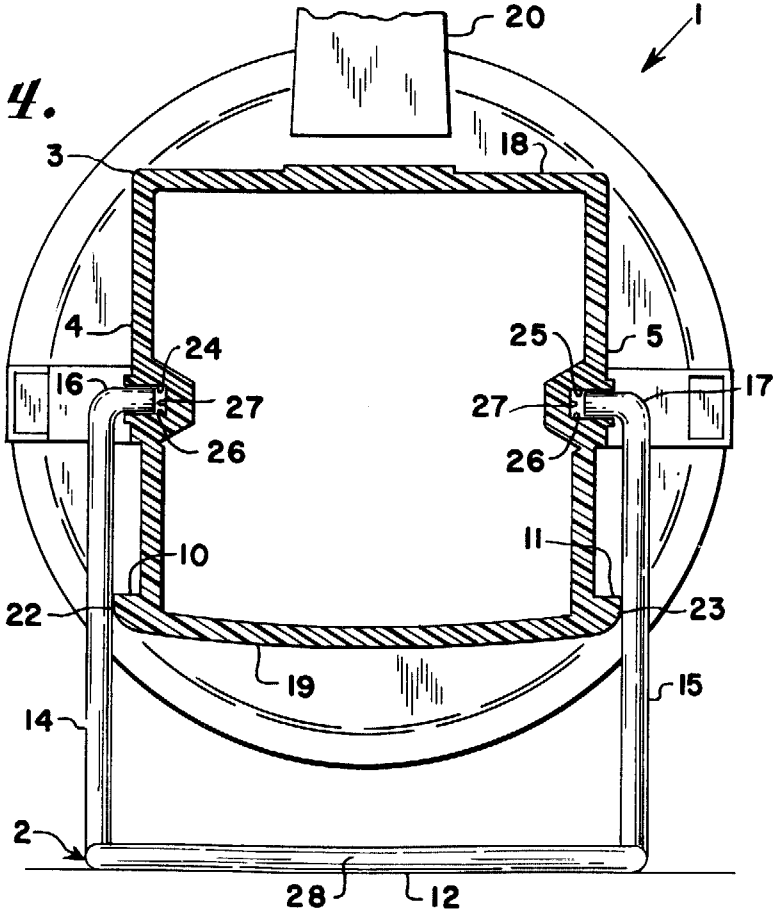
FIG. 4 is an enlarged fragmentary transverse sectional view taken on line 4—4, FIG. 2.

The positioning of the support structure in the storage position also provides a support to stand the lantern on end, as shown in FIG. 5. From the standing position the support structure and housing may be relatively turned to swing the housing from one limit where the position is approximately 10° from vertical in one direction past vertical to inclined positions in the other direction, as for example an angle as shown in FIG. 1. This movement may be continued to a limit wherein the side arms 14 and 15 engage the bezel portion wherein the lantern is inclined downwardly. The frictional engagement of the arms 14 and 15 with the rib edges is such that when the turning force stops, the support structure 2 and housing remain at that selected relative position until forcibly moved to another position.

It is to be understood that while I have illustrated and described one form of my invention, it is not to be limited to the specific form or arrangement of parts herein described and shown.

What I claim and desire to secure by Letters Patent is:

1. An article and a support structure therefor and comprising:

a. an elongated housing having side walls and an end wall;

b. means on said side walls of said housing defining a pair of axially aligned recesses, said recesses extending transversely of said housing;

c. means on said side walls of said housing and extending outwardly therefrom to define a pair of opposed and aligned ribs each having an edge thereof spaced outwardly from said side walls;

d. a support structure for said housing and having a base portion and a pair of laterally spaced arms extending therefrom and each having an end portion thereof pivotally received in a respective one of said axially aligned recesses, said arms each being resiliently retained in frictional engagement with the edge of a respective one of said ribs whereby said housing may be moved to a selected position relative to said arms and frictionally retained in the selected position;

e. said means on said side walls defining each of said recesses include an end surface and a side surface; and f. the end portion on each of said arms has an end spaced from the end surface of the respective recess when said arms are each in engagement with the edges of said respective ribs.

2. In combination:

a. a housing having laterally spaced side walls and opposite ends;

b. an elongated outstanding portion on each of said side walls in opposed relation and each having a crest extending longitudinally of said housing;

c. a support structure for said housing and having a base portion and laterally spaced arms extending from said base portion, said arms each having a gudgeon thereon pivotally supported on a respective one of said side walls of said housing, said arms being resiliently retained in frictional engagement with said crests whereby said housing may be moved to a selected position relative to said arms and frictionally retained in the selected position;

d. said arms of said support structure are biased toward said respective side wall of said housing; and e. said outstanding portions each have an end portion adjacent one of said opposite ends of said housing terminating in shoulders inclined toward said respective side wall, said shoulders being engaged by said arms when said base portion of said support structure is moved to a position in facing relation with said one end of said housing.

3. In combination as set forth in claim 2 wherein:

a. said arms each have a portion thereof adjacent and substantially parallel with a respective one of said side walls;

b. the gudgeon of each of said arms is substantially normal to the crest engaging portion thereof; and c. said side walls of said housing each have a bearing recess therein to rotatably receive the gudgeon of a respective one of said arms.

4. In combination:

a. a housing having laterally spaced side walls and opposite ends;

b. an elongated outstanding portion on each of said side walls in opposed relation and each having a crest extending longitudinally of said housing;

c. a support structure for said housing and having a base portion and laterally spaced arms extending from said base portion, said arms each having a gudgeon thereon pivotally supported on a respective one of said side walls of said housing, said arms being resiliently retained in frictional engagement with said crests whereby said housing may be moved to a selected position relative to said arms and frictionally retained in the selected position;

d. said arms each have a portion thereof adjacent and substantially parallel with a respective one of said side walls;

e. the gudgeon of each of said arms is substantially normal to the crest engaging portion thereof;

f. said side walls of said housing each have a bearing recess therein to rotatably receive the gudgeon of a respective one of said arms;

g. each of said recesses are defined by an end surface and a side surface;

h. the gudgeon on said arms each engage the side surface of said repsective recess; and i. the gudgeons on each of said arms has an end spaced from the end surface of said respective recess when said arms are in engagement with the crests of said outstanding portions.

5. In combination:

a. a housing having laterally spaced side walls and opposite ends;

b. an elongated outstanding portion on each of said side walls in opposed relation and each having a crest extending longitudinally of said housing;

c. a support structure for said housing and having a base portion and laterally spaced arms extending from said base portion, said arms each having a gudgeon thereon pivotally supported on a respective one of said side walls of said housing, said arms being resiliently retained in frictional engagement with said crests whereby said housing may be moved to a selected position relative to said arms and frictionally retained in the selected position;

d. said base portion of said support structure has an end member and laterally spaced side members extending from said end member;

e. said arms each extend from a respective one of said side members of said base portion and are substantially coplanar therewith when engaged with said outstanding portions;

f. said arms are each biased toward said respective side wall of said housing;

g. said outstanding portions each have an end portion adjacent one of said opposite ends of said housing;

h. said end portion of each of said outstanding portions tapers between the crests thereof and said respective side wall whereby said one opposite end of said housing moves between said side members of said base portion and said arms of said support structure each engage said end portion of said outstanding portions of said housing when said base portion of said support structure is moved to a position in facing relation with said one end of said housing;

i. each of said side walls of said housing are substantially planar members;

j. said arms each have a portion thereof adjacent and substantially parallel with a respective one of said side walls;

j. the gudgeons are one end portion of each of said arms and are substantially normal to said parallel portions thereof; and k. said side walls of said housing each have a recess therein to rotatably receive the one end portion of a respective one of said arms;

6. In combination as set forth in claim 5 wherein:

a. each of said recesses are defined by an end surface and a side surface;

b. the one end portion of said arms each engage the side surface of said respective recess; and c. the one end portion of each of said arms has an end spaced from the end surface of said respective recess when said arms are in engagement with the crests of said outstanding portions.

7. An article and a support structure therefor and comprising:

a. an elongated housing having side walls and an end wall;

b. means on said side walls of said housing defining a pair of axially aligned recesses, said recesses extending transversely of said housing;

c. means on said side walls of said housing and extending outwardly therefrom to define a pair of opposed and aligned ribs each having an edge thereof spaced outwardly from said side walls;

d. a support structure for said housing and having a base portion and a pair of laterally spaced arms extending therefrom and each having an end portion thereof pivotally received in a respective one of said axially aligned recesses, said arms each being resiliently retained in frictional engagement with the edge of a respective one of said ribs whereby said housing may be moved to a selected position relative to said arms and frictionally retained in the selected position;

e. said arms of said support structure are each biased toward said side wall of said housing;

f. said ribs each have an end portion adjacent said end wall; and g. said end portion of each of said ribs tapers between the edge of said ribs and said side wall of said housing whereby said arms of said support structure each engage an adjacent portion of said side wall when said base portion of said support structure is moved to a position in facing relation with said one end wall of said housing;

h. said means on said side wall defining each of said recesses includes an end surface and a side surface; and i. the end portion of each of said arms has an end spaced from the end surface of said respective recess when said arms are each in engagement with the edges of said respective ribs.

* * * * *